US008544486B1

(12) United States Patent
Hardwick

(10) Patent No.: US 8,544,486 B1
(45) Date of Patent: Oct. 1, 2013

(54) WALKER ADAPTER

(76) Inventor: Eryk Hardwick, Naples, FL (US)

( * ) Notice: Subject to any disclaimer, the term of this patent is extended or adjusted under 35 U.S.C. 154(b) by 0 days.

(21) Appl. No.: 12/901,027

(22) Filed: Oct. 8, 2010

(51) Int. Cl.
*A61H 3/00* (2006.01)

(52) U.S. Cl.
USPC ..... 135/67; 135/77

(58) Field of Classification Search
USPC ..... 135/66, 67, 77; 16/42 R, 42 T, 43; 482/66, 68; 182/107, 108
See application file for complete search history.

(56) References Cited

U.S. PATENT DOCUMENTS

| | | | | |
|---|---|---|---|---|
| 2,243,723 | A * | 5/1941 | Tench | 105/457 |
| 2,627,904 | A * | 2/1953 | Thieman | 482/66 |
| 3,618,703 | A * | 11/1971 | Wilke | 182/107 |
| 3,712,652 | A * | 1/1973 | Uilkema | 403/108 |
| 4,005,859 | A * | 2/1977 | Tait | 482/66 |
| 4,021,033 | A * | 5/1977 | Auclair et al. | 482/66 |
| 4,474,202 | A * | 10/1984 | Blechner | 135/67 |
| 5,295,498 | A * | 3/1994 | Van Meter et al. | 135/65 |
| 5,417,302 | A * | 5/1995 | McElfresh | 182/108 |
| 5,862,824 | A * | 1/1999 | Herman | 135/68 |
| 6,164,305 | A * | 12/2000 | Herman | 135/68 |
| 7,581,556 | B2 * | 9/2009 | Haslach et al. | 135/84 |
| 2011/0232665 | A1 * | 9/2011 | Barnett, Jr. | 132/200 |

* cited by examiner

*Primary Examiner* — Noah Chandler Hawk
(74) *Attorney, Agent, or Firm* — The Livingston Firm; Edward M. Livingston, Esq.; Bryan L. Loeffler, Esq.

(57) ABSTRACT

An adapter for use with a walker is disclosed. The adapter has a mesh that includes a running surface for engaging soft surfaces such as sand, dirt, and the like, into which conventional walker legs generally sink. A post on the adapter is configured to lockingly engage an end portion of one of the walker legs. Optionally, each adapter has two posts that are separated from each other by a distance that is substantially equal to a distance between end portions of two legs of a walker. In use, the adapter is positioned lateral to a user's feet, substantially outside of the space defined by a walker handrail, to avoid the user stepping on or tripping over the adapter.

13 Claims, 9 Drawing Sheets

WALKER ADAPTER

BACKGROUND

Walkers are generally used by individuals who have poor balance and/or diminished muscle strength which impede their ability to support themselves during ambulation. Conventional walkers have at least one front leg and two rear legs connected at their upper ends to a handrail. The lower end of each leg generally has a tip or a wheel mounted thereon. While this configuration is useful for moving across a substantially firm surface such a floor or sidewalk, conventional walkers cannot generally be used for moving across soft ground such as sand, dirt, snow, and the like, because the tips or wheels mounted on the lower end of each leg sink into the soft ground.

SUMMARY

In an embodiment, an adapter for use with a walker is disclosed. The adapter has a member defined by proximal and distal sides. Optionally, the member is a mesh. The adapter has a length and a width that is less than its length and a running surface. A post is positioned near the proximal side of the member that is configured to lockingly engage an end portion of one of the walker legs.

In another embodiment, a walker assembly is disclosed. The walker assembly has a handrail configured to partially surround a torso of a user and that defines a space. There are at least three legs, each having an upper end portion that connects to the handrail and a lower end portion. An adapter is configured to be positioned substantially outside of the space during use. The adapter includes a member having a length that is at least substantially equal to a distance between two of the legs, a width that is less than the length, and a running surface. A post is positioned near a proximal side of the member and is configured to engage the lower end portion of one of the legs of the walker. Optionally, the adapter has two posts that are separated by a distance substantially equal to a distance between end options of two of the legs.

These and other details, objects, and advantages of the walker adapter release will become better understood or apparent from the following descriptions, examples, and figures showing embodiments thereof.

DETAILED DESCRIPTION

Figure 1A:
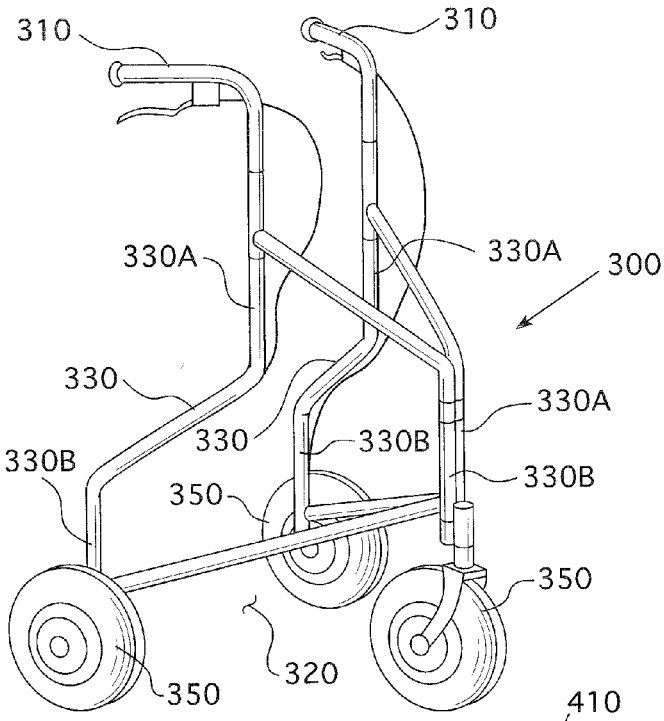
FIG. 1 shows a perspective view of a conventional walker having three (A) or four (B) legs.
Figure 1B:
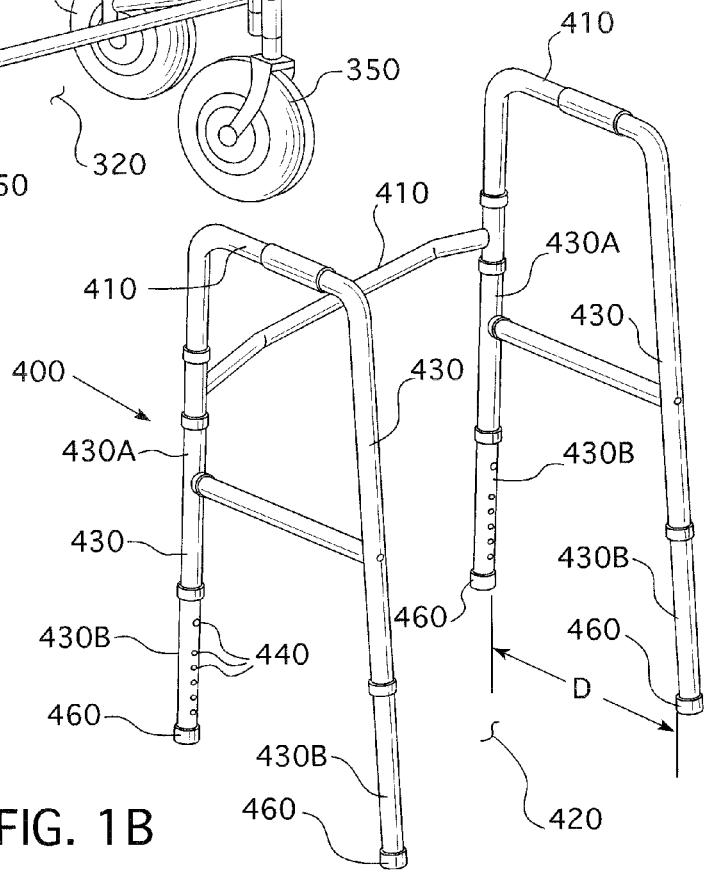

Configurations of conventional walkers 300, 400 are depicted in FIGS. 1A and 1B, respectively. The walker 300, 400 has a handrail 310, 410 that defines a space 320, 420 and that is configured to partially surround a torso of a user. As shown, the walker 300, 400 typically has either three 330 (FIG. 1A) or four 430 (FIG. 1B) legs. Each leg 330, 430 has an upper end portion 330A, 430A that connects to the handrail 310, 410 and a lower end portion 330B, 430B that has a series of detent holes 340. Optionally, the lower end portion 330B, 430B is an adjustable extension that mates with a detent 345, 445 on a body of the leg 330, 430. In embodiments, the walker 300, 400 includes wheels 350 (FIG. 1A) or rubber tips 460 (FIG. 1B) positioned on the tip of the lower end portion 330B, 430B.

Figure 5A:
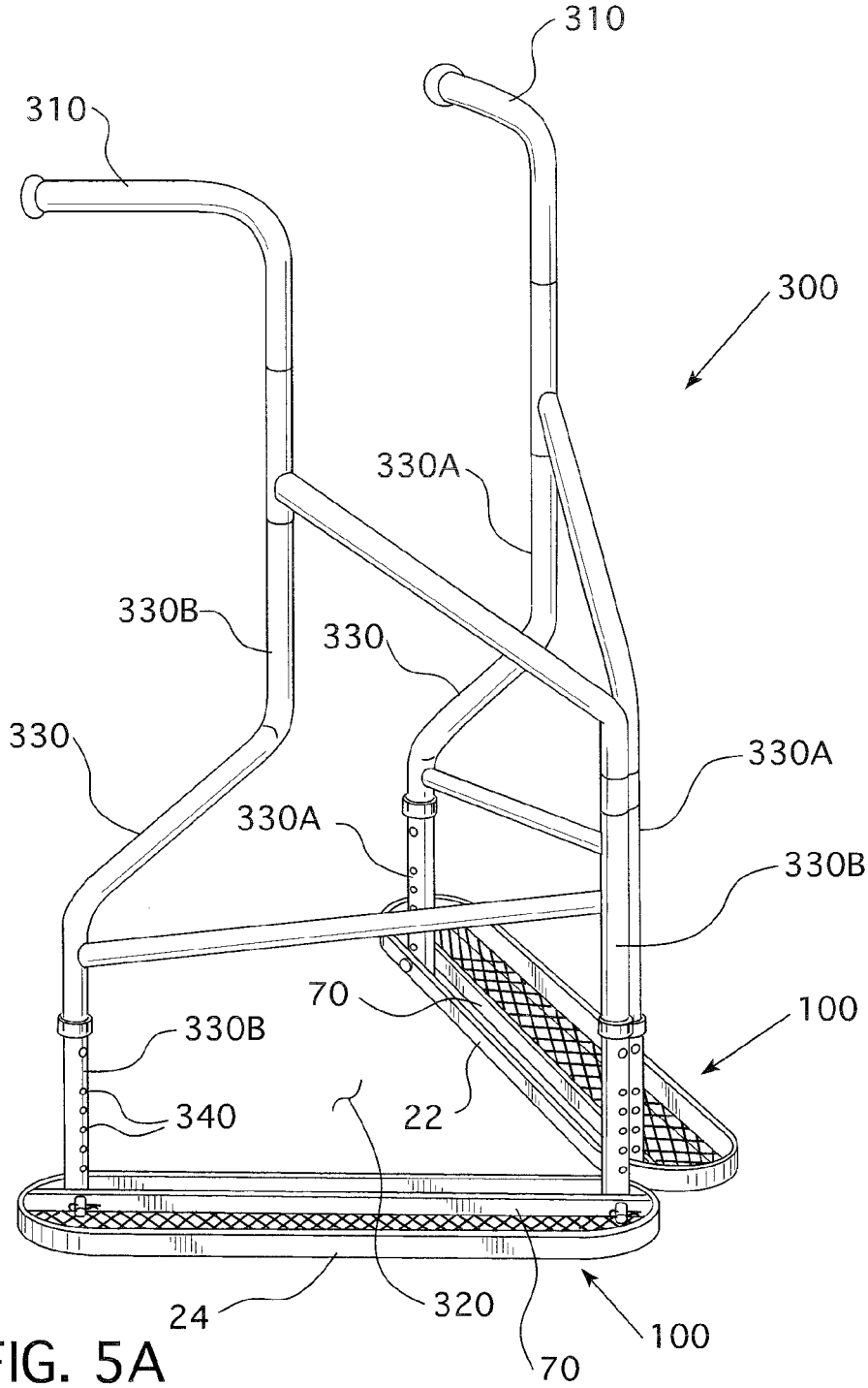
FIGS. 5A and 5B show embodiments of the adapter in combination with a walker having three or four legs.
Figure 5B:
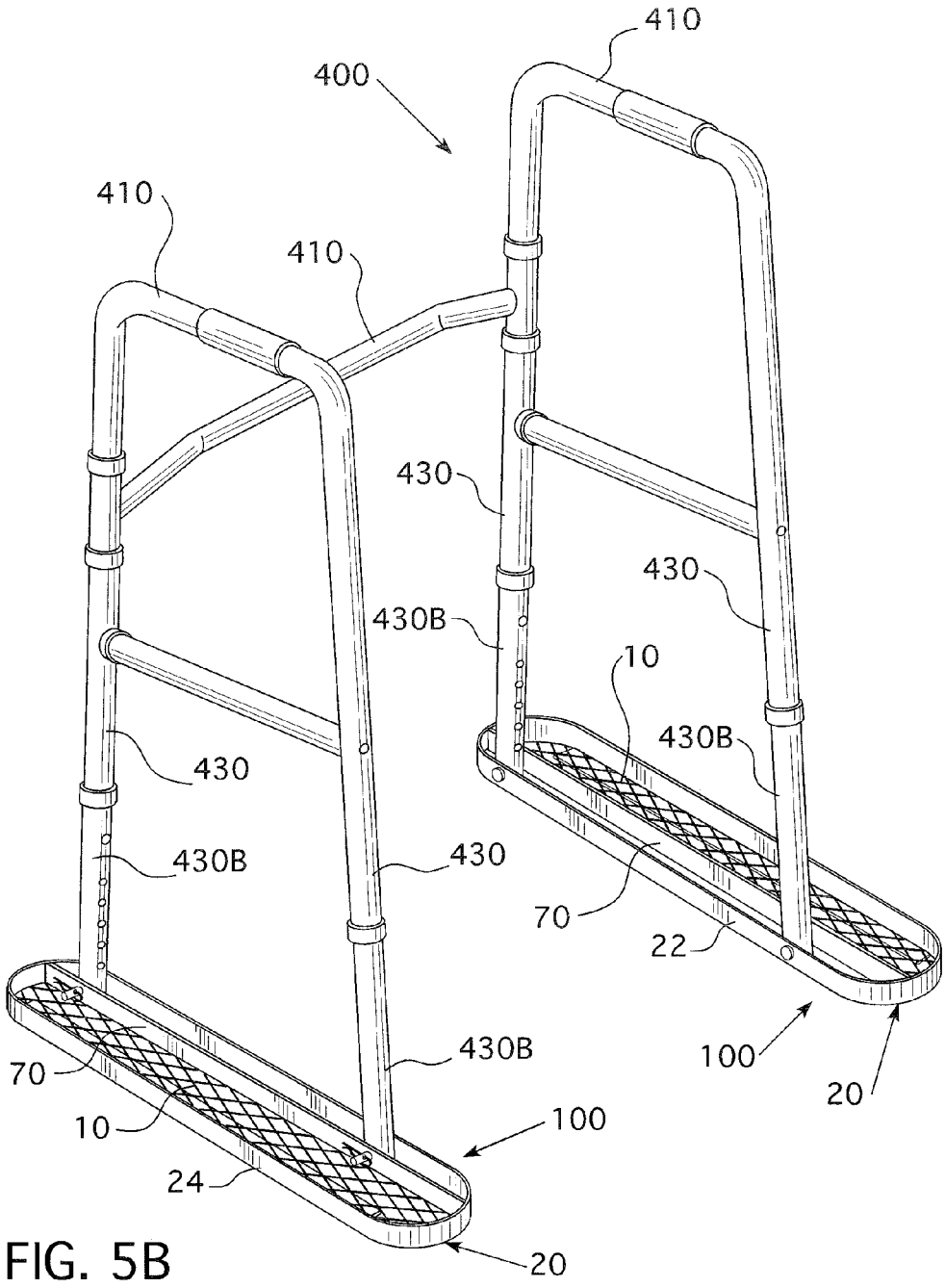

An adapter 100 for use with a walker 300, 400 such as the ones shown in FIG. 1 is disclosed. As shown in FIGS. 5A and 5B, the adapter 100 attaches to the lower end portion 330B, 430B of at least one leg of a walker 300, 400 and adapts the walker 300, 400 for use across soft ground such as sand, dirt, snow, and the like to provide stability to the user and to prevent the walker wheel 350 or tip 460 from sinking into the soft ground as the walker 300, 400 is moved across the soft ground. As described in more detail below, the adapter 100 is configured for use by users of various heights.

Figure 2:
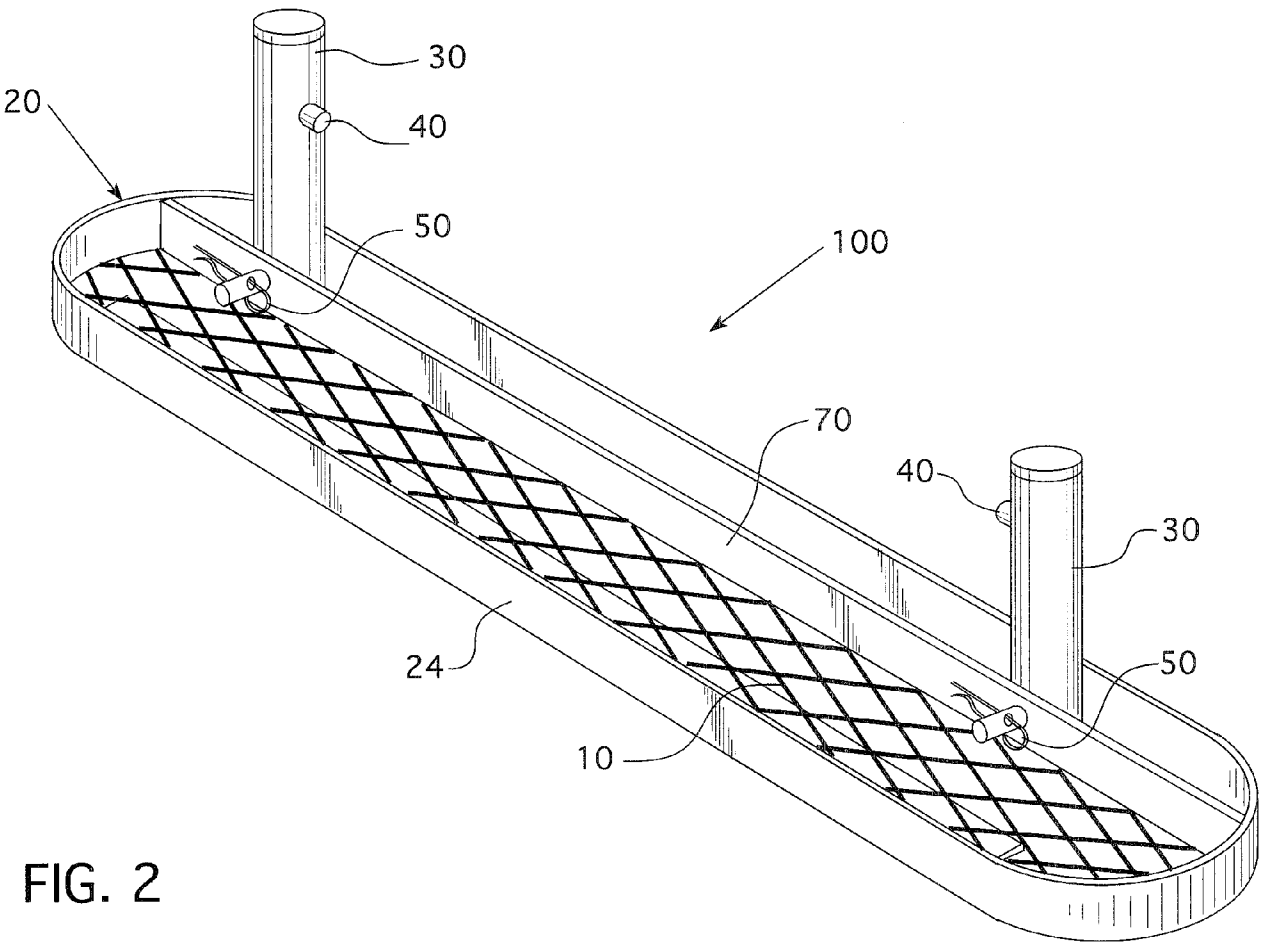
FIG. 2 shows a top perspective view of an embodiment of the adapter.

An embodiment 100 of the adapter is shown in FIG. 2. The adapter 100 has a member 10 having proximal and distal sides 12, 14 that define a length L. As shown in FIG. 7A, the length L of the member 10 is substantially equal to a distance D between the farthest points on opposed external surfaces of two legs of the walker 300, 400. As shown in FIG. 7B, the length L of the member 10 is greater than the distance D between the farthest points on opposed external surfaces of two legs of the walker 300, 400. Optionally, member 10 has an arch 18 at each end, as shown in FIGS. 2-6. The member 10 has a width W that is less than the length L. In examples, the length L of the member 10 ranges from about 16 inches to about 26 inches and the width W of the member 10 ranges from about 2 inches to about 12 inches.

In an example, member 10 is non-solid, as shown in FIGS. 2-6. Non-solid member 10 includes any holes, openings, or the like in member 10 that are of sufficient size that the non-solid member 10 will not clog during use. Openings can be of a variety of shapes and dimensions depending upon the anticipated ground surface with which adapter 100 would be used. For instance, the shape of the openings can be substantially oval or square and positioned contiguously with each other throughout member 10. In an example, openings are diamond shaped. Openings are large enough to allow ground particles, such as sand, to enter through a central portion of the openings without clogging the openings, but not too large so as to offset stability provided by member 10. The interior edges of the openings can be flat or beveled.

Figure 8:
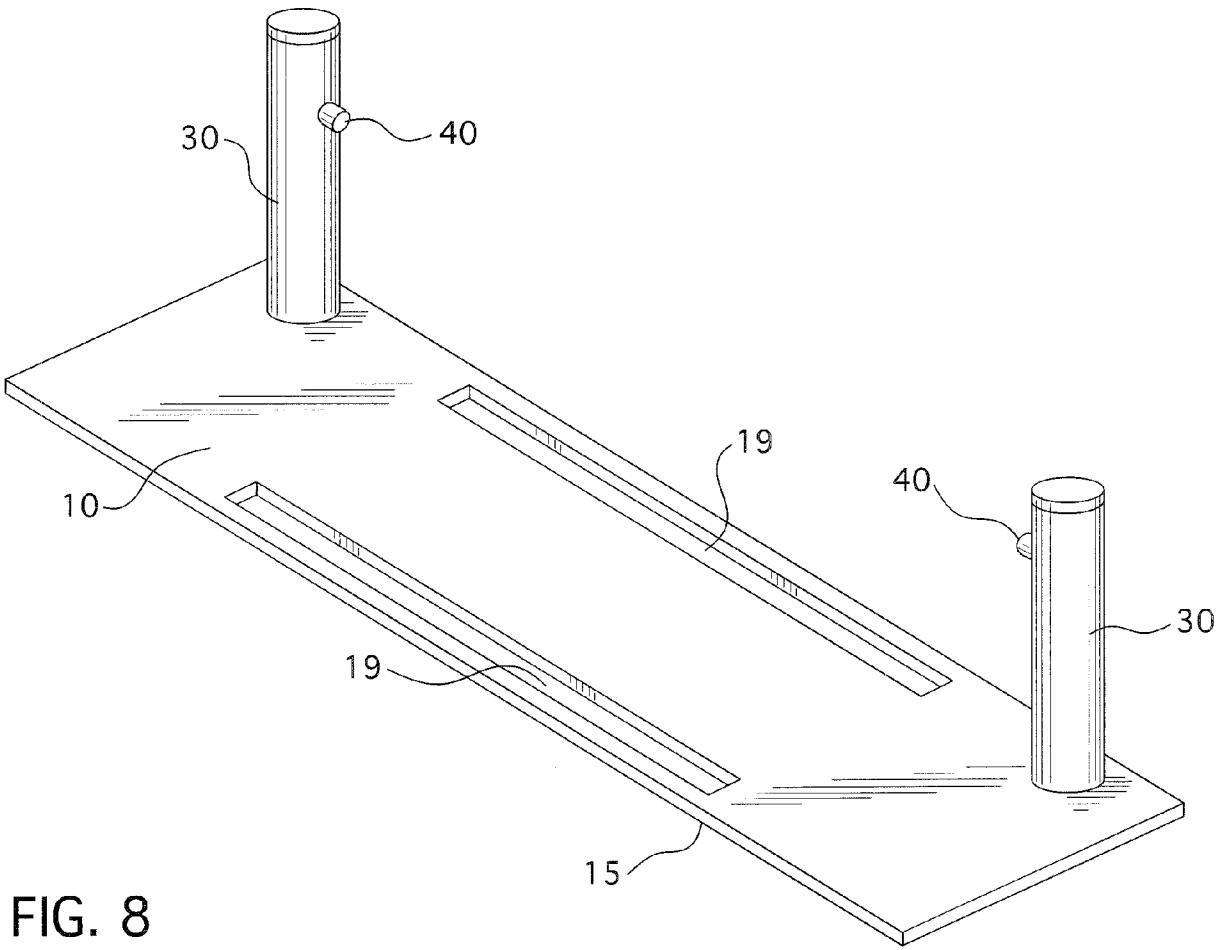
FIG. 8 shows a top perspective view of a second embodiment of the adapter.

In another example, member 10 has no holes or openings, but rather is solid, as shown in FIG. 8. Optionally, solid member 10 has at least one channel 19 that extends from top surface of member 10 through running surface 15. For example as shown in FIG. 8, member 10 includes two channels 19. Channel 19 can also be used with member 10 that is partially solid or non-solid. Non-solid member 10 or channel 19 provides means for substantially minimizing any build up or collection of water, sand, dirt, stones, pebbles, and the like on member 10 during use and minimize any suction between the ground surface and the running surface 15 (described below) during use.

Member 10 can be constructed from any material that is durable, water-resistant, and of sufficient rigidity to maintain its integrity on uneven ground surfaces such that member 10 does not bend or conform to the ground surface during use. In an example member 10 is prepared from expanded metal. In examples, member 10 is constructed from aluminum, galvanized metal, steel, stainless steel, expanded aluminum, expanded galvanized metal, expanded steel, expanded stainless steel or plastic. One skilled in the art will understand that the weight of the adapter 100 will be determined by a variety of factors, including the material from which member 10 and posts 30 (described below) are constructed and the length L and width W of member 10. Weight of adapter 100 must be sufficiently light that the adapter 100 will not impede a user's ability to maneuver the walker 300, 400 when adapter 100 is attached thereto.

Figure 3:
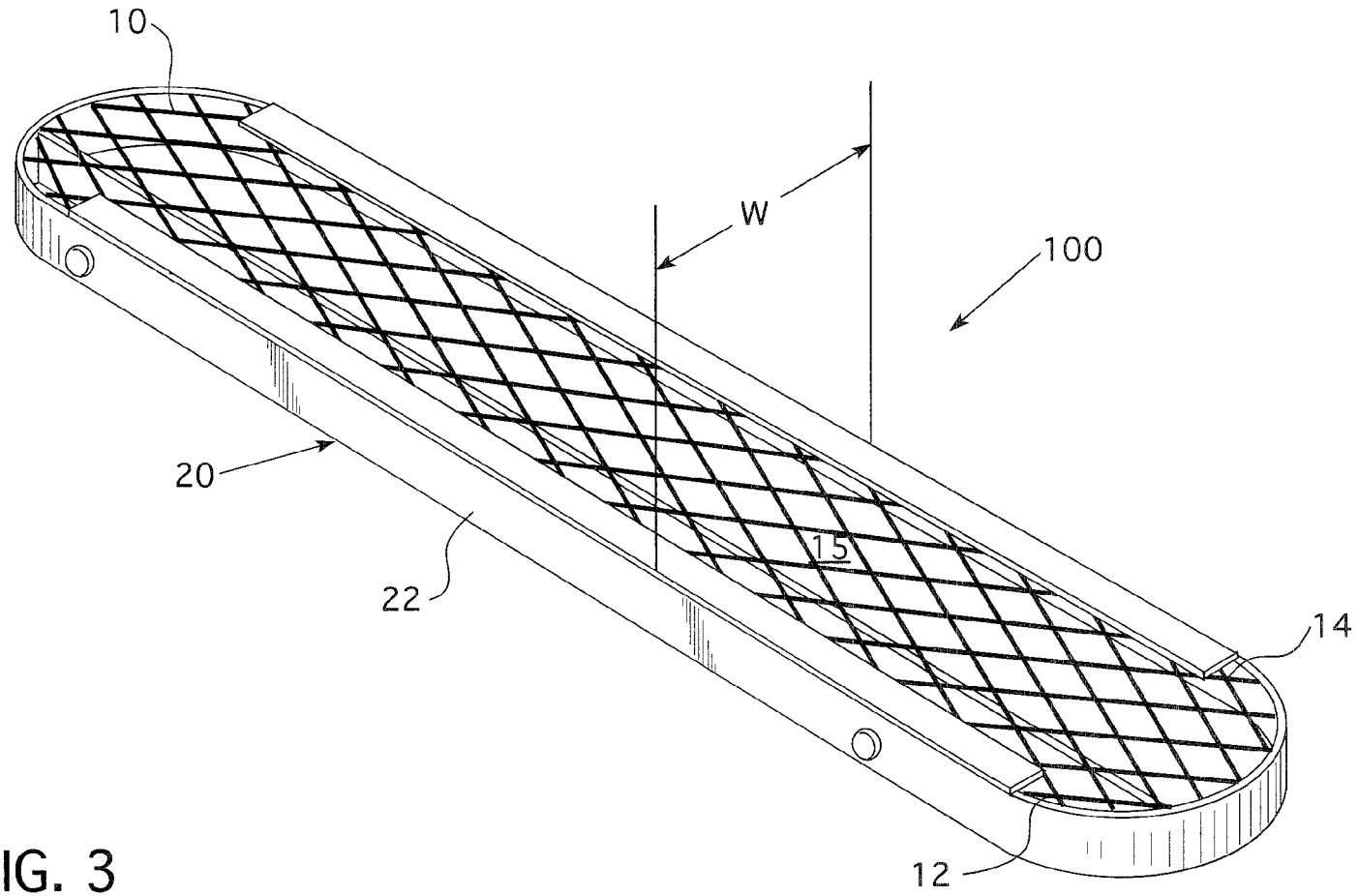
FIG. 3 shows a bottom perspective view of an embodiment of the adapter shown in FIG. 2.
Figure 4:
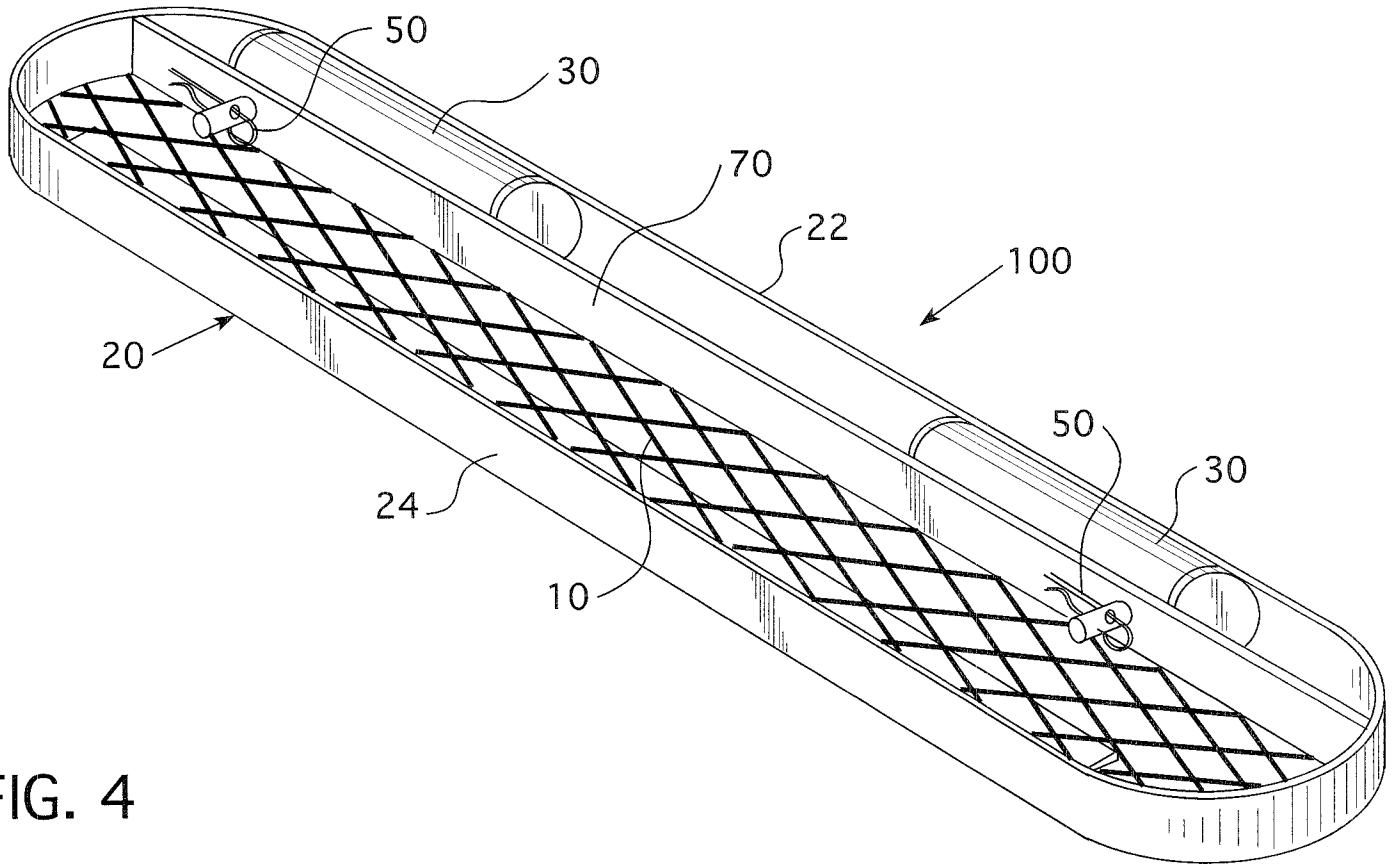
FIG. 4 shows a top perspective view of the adapter shown in FIG. 2 and having the posts in the fully collapsed position.

As shown in FIG. 3, the member 10 has a running surface 15 that engages the soft ground during use. In examples, running surface 15 is substantially smooth. In other examples, running surface 15 includes traction means (not shown) to help the running surface engage the ground surface.

Optionally, as shown in FIGS. 2-6, a frame 20 surrounds the member 10. The frame 20 defines an area 29 into which the member 10 is positioned.

As shown in the Figures, the adapter 100 also has at least one post 30 that is positioned near the proximal side 12 of the member 10. In the embodiments shown in FIGS. 2 and 4-8, the adapter 100 has two posts 30 that are separated by a distance d that is substantially equal to distance D between walker legs 330, 430.

Preferably, post 30 is adjustable along the length L of member 10 to accommodate users of various heights (described below). In the examples shown in FIGS. 2 and 4-6, adapter 100 includes a securing member 70 positioned near the proximal side of member 10. Post 30 is secured to securing member 70 by securing means 50, where securing means 50 includes welding, soldering, a nut and bolt configuration, or a pin and key configuration (shown in FIGS. 2 and 4-6), although any means known to those skilled in the art may be used to secure the post 30 to the securing member 70. In the example shown in FIGS. 2 and 4-6, securing member 70 includes at least one hole 72 configured to receive securing means 50. Optionally, securing member 70 includes a plurality of holes 72 along a length so that post 30 may be secured to securing member 70 at one of the holes 70, thereby making the post 30 adjustable along the length L of member 10 to accommodate users of various heights (described below). In the example shown in FIG. 8, post 30 is secured to member 10, such as by welding, soldering, a nut and bolt configuration or a pin and key configuration, although any means known to those skilled in the art may be used to secure the post 30 to the member 10. Optionally, member 10 includes a plurality of holes 11 along length L so that post 30 may be secured to member at one of the holes 11, thereby making the post 30 adjustable along the length L of member 10 to accommodate users of various heights (described below). Optionally, the post 30 is removable or collapsible for convenient storage and transportation of adapter 100. Post 30 can be constructed from any material that is durable, water-resistant, and of sufficient strength to support a user's weight during use of the walker 300, 400. In examples, post 30 is constructed from aluminum, galvanized metal, steel, stainless steel, or plastic.

Each post 30 is configured to lockingly engage an end portion 330B, 430B of one of the legs 330, 430 of the walker 300, 400. In the embodiments shown in the Figures, each post 30 has a spring-biased button-type detent 40 that mates with the detent holes 340, 440 on the lower end portion 330B, 430B of a walker leg 330, 430, although any locking means known to those skilled in the art may be used to lock the post 30 to the walker leg 330, 430.

Figure 6:
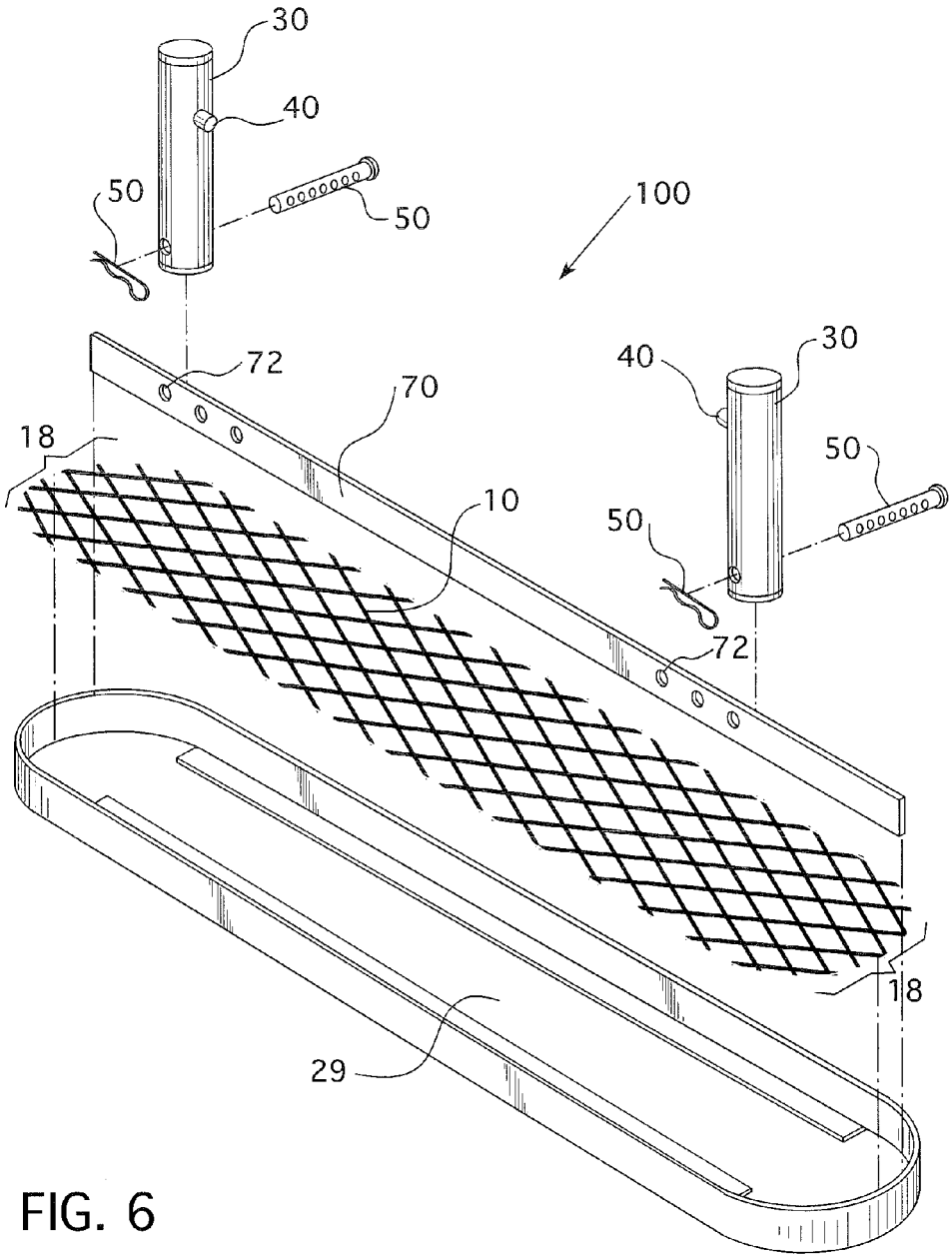
FIG. 6 shows an exploded view of the adapter shown in FIG. 2.
Figure 7A:
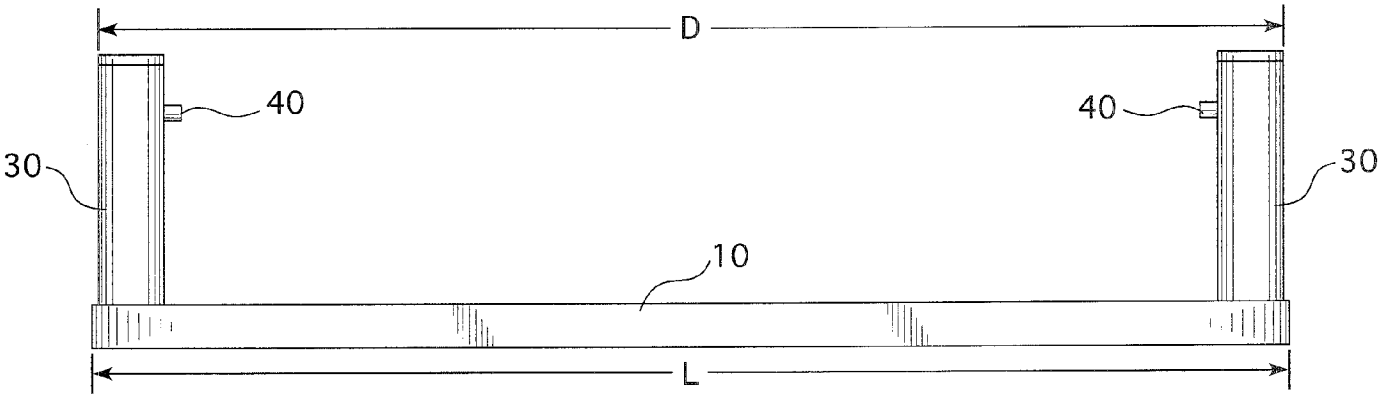
FIGS. 7A and 7B show side views of embodiments of the adapter.
Figure 7B:
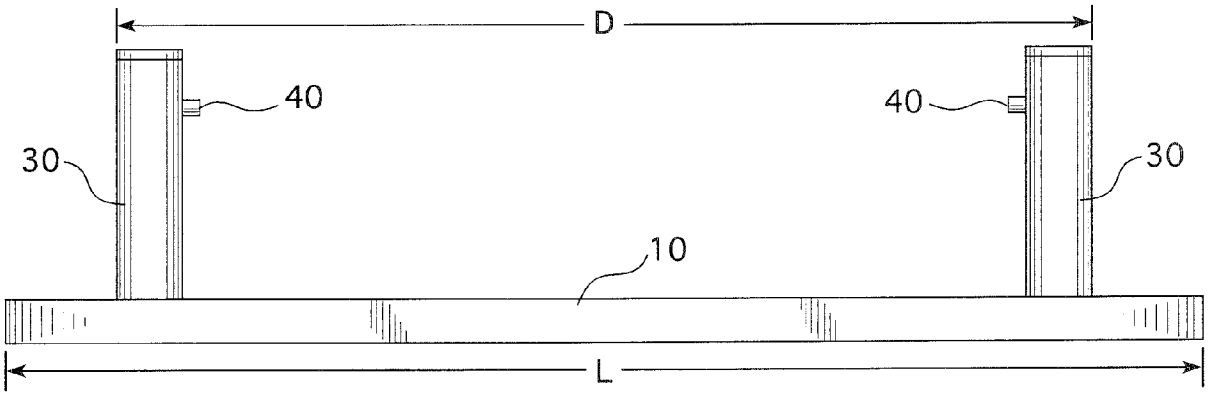

The adapter 100 is shown in combination with a walker 300, 400 in FIG. 5 and an exploded view is shown in FIG. 6. The walker handrail 310, 410 is configured to partially surround a user's torso. The handrail 310, 410 defines a space 320, 420 in which the user stands during use. The walker 300, 400 has either three 330 (FIG. 5A) or four 430 (FIG. 5B) legs. Each walker leg 330, 430 has upper 330A, 430A and lower end portions. The upper end portion 330A, 430A connects to the handrail 310, 410. The post 30 of the adapter 100 is configured to engage the lower end portion 330B, 430B. In the embodiments shown, the lower end portion of each leg 330B, 430B has a series of detent holes 340, 440 that mate with a spring biased button-type detent 40 on the corresponding post 30 of the adapter 100.

Prior to use, the user adjusts the walker 300, 400 to a height that is appropriate for the user's height and post 30 is secured to member 10 or securing member 70 so that the position of post 30 along length L of adapter 100 corresponds to the height to which the walker 300, 400 is adjusted. In an example, for a user having a height of about 5'0" to about 5'6", the distance d between two posts 30 on adapter 100 is about 16 inches. In another example, for a user having a height greater than about 5'6", the distance d between two posts 30 on adapter 100 is about 16.75". In use, the adapter 100 is positioned substantially outside of the space 320, 420 so that the user does not step on or trip over the adapter.

While the foregoing has been set forth in considerable detail, it is to be understood that the drawings, detailed embodiments, and examples are presented for elucidation and not limitation. Design variations, especially in matters of shape, size, and arrangements of parts, may be made but are within the principles of the invention. Those skilled in the art will realize that such changes or modifications of the invention or combinations of elements, variations, equivalents, or improvements therein are still within the scope of the invention as defined in the appended claims.

I claim:

1. An adapter for use with a walker having four tubular legs extending downward from one or more hand rails configured to partially surround a user and to provide support for the user while walking in an upright position, said four legs each having distal ends with one or more detent holes located proximal thereto, said adapter comprising:

a substantially rectangular-shaped elongated member having a first end, a second end and two sides;

at least one frame that extends up from each side a predetermined distance;

said at least one frame being perpendicular to said elongated member;

a first tubular post located proximate to the first end of the elongated member and attached to the at least one frame;

a second tubular post located proximate to the second end of the elongated member and attached to the at least one frame;

said posts being separated by a distance substantially equal to a distance between two of the four legs of the walker; and said first post and second post both being in fixed positions in relation to the elongated member and to the legs to which the first post and second post, respectively, are attached when the adapter is attached to the walker, thereby not allowing for any movement between the adapter and the walker.

2. The adapter of claim 1 further comprising:

a spring biased button located on the first post for engaging the one or more detent holes located on one of the four legs of the walker; and a spring biased button located on the second post for engaging the one or more detent holes located on one of the four legs of the walker.

3. The adapter of claim 1 further comprising:

said elongated member having a plurality of holes located thereon.

4. The adapter of claim 1 wherein:

said first end of the substantially rectangular-shaped elongated member has an arch.

5. The adapter of claim 4 wherein:

said second end of the substantially rectangular-shaped elongated member has an arch.

6. A walker and adapter comprising:

four tubular legs extending downward from one or more hand rails configured to partially surround a user and to provide support for the user while walking in an upright position, said four legs each having distal ends with one or more detent holes located proximal thereto;

said adapter having a substantially rectangular-shaped elongated member having a first end, a second end and two sides;

said adapter having at least one frame that extends up from each side a predetermined distance;

said adapter having said at least one frame being perpendicular to said elongated member;

said adapter having a first tubular post located proximate to the first end of the elongated member and attached to the at least one frame;

said adapter having a second tubular post located proximate to the second end of the elongated member and attached to the at least one frame;

said posts being separated by a distance substantially equal to a distance between two of the four legs of the walker;

said first post and second post both being in fixed positions in relation to the elongated member and to the legs to which the first post and second post, respectively, are attached when the adapter is attached to the walker, thereby not allowing for any movement between the adapter and the walker.

7. The adapter of claim 6 further comprising:

a spring biased button located on the first post for engaging the one or more detent holes located on one of the four legs of the walker; and a spring biased button located on the second post for engaging the one or more detent holes located on one of the four legs of the walker.

8. The adapter of claim 6 further comprising:

said elongated member having a plurality of holes located thereon.

9. The adapter of claim 6 wherein:

said second end of the substantially rectangular-shaped elongated member has an arch.

10. A walker and adapter comprising:

four tubular legs extending downward from one or more hand rails configured to partially surround a user and to provide support for the user while walking in an upright position, said four legs each having distal ends with one or more detent holes located proximal thereto;

said adapter having a substantially rectangular-shaped elongated member having a first end, a second end and two sides;

said adapter having at least one frame that extends up from each side a predetermined distance;

said adapter having said at least one frame being perpendicular to said elongated member;

said adapter having a first tubular post located proximate to the first end of the elongated member and attached to the at least one frame;

said adapter having a second tubular post located proximate to the second end of the elongated member and attached to the at least one frame;

said posts being separated by a distance substantially equal to a distance between two of the four legs of the walker;

said first post and second post both being in fixed positions in relation to the elongated member and to the legs to which the first post and second post, respectively, are attached when the adapter is attached to the walker, thereby not allowing for any movement between the adapter and the walker; and said elongated member having a plurality of holes arranged in a substantially grid shaped pattern located thereon.

11. The adapter of claim 10 further comprising:

a spring biased button located on the first post for engaging the one or more detent holes located on one of the four legs of the walker; and a spring biased button located on the second post for engaging the one or more detent holes located on one of the four legs of the walker.

12. The adapter of claim 10 wherein:

said first end of the substantially rectangular-shaped elongated member has an arch.

13. The adapter of claim 12 wherein:

said second end of the substantially rectangular-shaped elongated member has an arch.

* * * * *